US005120163A

United States Patent [19]

Holdeman et al.

[11] Patent Number: 5,120,163

[45] Date of Patent: Jun. 9, 1992

[54] FOUNDATION UNDERPINNING BRACKET AND JACKING TOOL ASSEMBLY

[75] Inventors: Maynard L. Holdeman, Centralia, Mo.; Ronnie J. Hargrave, Farmersville, Tex.; Richard E. Thorsten, Missouri City, Tex.

[73] Assignee: A.B. Chance Company, Centralia, Mo.

[21] Appl. No.: 624,123

[22] Filed: Dec. 7, 1990

[51] Int. Cl.[5] ..... E02D 5/00

[52] U.S. Cl. ..... 405/230; 405/229

[58] Field of Search ..... 405/229, 230; 254/29 R

[56] References Cited

U.S. PATENT DOCUMENTS

| | | | |
|---|---|---|---|
| 4,854,782 | 8/1989 | May | 405/230 |
| 4,911,580 | 3/1990 | Gregory et al. | 405/230 |
| 5,011,336 | 4/1991 | Hamilton et al. | 405/230 |

*Primary Examiner*—Dennis L. Taylor

*Attorney, Agent, or Firm*—Hovey, Williams, Timmons & Collins

[57] ABSTRACT

Apparatus and a method is disclosed for stabilizing the foundation of an existing building structure which may or has experienced settlement or movement. A support for the foundation is provided that is adapted to be located at a position in underlying relationship to the foundation structure. A screw anchor having an anchor shaft and at least one helix thereon is driven into the ground adjacent the foundation support. An inverted U-shaped coupler adapted to be temporarily secured to the foundation support receives a jacking device therewithin extending between the top of the coupler and the foundation support so that upon positioning of the support in supporting relationship to the foundation and insertion of the anchor into the ground, the support may be connected to the anchor shaft, the jacking device positioned between the support and the coupler so that added force may be applied to the support and thereby the foundation while the support and foundation are carried by the screw anchor, the support then affixed to the screw anchor, and the jacking device thereafter removed from its position between the base member and the coupler.

7 Claims, 4 Drawing Sheets

FOUNDATION UNDERPINNING BRACKET AND JACKING TOOL ASSEMBLY

BACKGROUND OF THE INVENTION

1. Field of the Invention

This invention relates to improved apparatus for stabilizing the foundation of an existing building structure which may or has experienced settlement or movement. More particularly, it is concerned with apparatus and a method for stabilizing the below-ground foundation of building or the like wherein a support is positioned in supporting relationship to the foundation, a screw anchor is driven into the ground adjacent the support, a lifting force is applied to the support in the foundation using the screw anchor as a base for such lifting force, and the support is thereafter affixed to the screw anchor.

2. Description of the Prior Art

Many homeowners face the disconcerting and oftentimes expensive problem of foundation settling. This phenomenon can arise by virtue of loose, sandy soil around the foundation, undue moisture conditions, expansive soils or improper original construction of the foundation. In any case, solving the settling problem and properly supporting the foundation (and usually the basement floor) is typically a very involved and costly proposition.

Various techniques have been proposed in the past for supporting below-grade structural footings. For example, U.S. Pat. No. 2,982,103 describes a system wherein a bracket is attached to the basement walls, and a hole is bored through the adjacent floor. Elongated pipe sections are hydraulically driven downwardly through the floor until a bearing region such as bedrock is reached, whereupon the pipe sections are coupled to the wall-mounted bracket. Such systems are very costly to install. Additional patents describing various underpinning methods using hydraulic rams are described in U.S. Pat. Nos. 3,902,326, 3,796,055, 3,852,970, and 4,634,319.

U.S Pat. Nos. 4,673,315 and 4,765,777 are exemplary of prior practices and systems wherein a piling is driven into the ground using a hydraulic ram until the piling encounters a predetermined resistance whereupon the ram is further actuated to raise the foundation or a slab a predetermined distance.

In addition, it has been known in the past to use embedded earth anchors as a means of supporting foundations or footings. For instance, anchors have been installed vertically beneath a footing, with plural anchors being interconnected with reinforced concrete. In other instances, plural anchors have been driven at various angles and tied together to the footing with reinforcing bars or hairpin connectors; such connection structure then being cast in concrete.

Despite these prior attempts, however, there is a distinct need in the art for an improved, easy to install system for providing load-bearing support for structural footings. Advantageously, such a system should be low in cost and readily installable from the outside of a house or other structure.

SUMMARY OF THE INVENTION

The present invention overcomes the problems outlined above by provision of an improved foundation support and screw anchor assembly which allows a lifting force to be applied to the support and foundation utilizing the screw anchor as a base for such lifting force so that only the support and foundation move upwardly and there is no concomitant downward movement of the screw anchor.

The ground surrounding the foundation of the building to be stabilized is first excavated in the areas where each support and screw anchor assembly is to be located along the length of the foundation. An L-shaped bracket assembly having a foundation support plate portion is then positioned under the footing or foundation at each excavation point. A screw anchor is then placed adjacent each bracket assembly and rotational torque imparted to the shaft of the screw to anchor to drive the latter into the ground until a predetermined rotational torque resistance is experienced and the upper end of the anchor shaft is proximal to the plate portion of the bracket assembly.

Connector means is provided for joining the L-shaped foundation support plate structure and which includes a tubular member adapted to be telescoped over the upper end of the adjacent screw anchor shaft. A base member secured to the upper end of the tubular member may serve as a temporary support for a jacking device. The support plate structure of the bracket assembly is not initially fixed to the tubular member and base member thereon, and therefore the plate structure may move to a certain extent with respect to the tubular member telescoped over the anchor shaft during application of a lifting force to the support plate structure by use of the jacking device.

An inverted L-shaped coupler is temporarily secured to the bracket assembly in disposition such that the upper cross member thereof is located above and in general alignment with the base member. Thus, a jack may be temporarily placed between the base member and the cross member of the coupler to lift the coupler and thereby the L-shaped plate structure of the bracket assembly relative to the base member and tubular member which are directly carried by the upper end of the anchor shaft.

In this manner, after driving of the anchor into the ground, a jacking device may be utilized to raise or lift the foundation, or to apply a predetermined lifting force thereon, utilizing the screw anchor as a base for such rasing or lifting force without fear of the screw anchor base being driven further into the ground. The tubular member and base member thereon are next firmly affixed to the L-shaped foundation supporting bracket structure so that upon removal of the jacking device and the coupler, the building foundation is fully stabilized at that location by the combination screw anchor and L-bracket support secured thereto.

DETAILED DESCRIPTION OF ONE EMBODIMENT OF THE INVENTION

Figure 1:
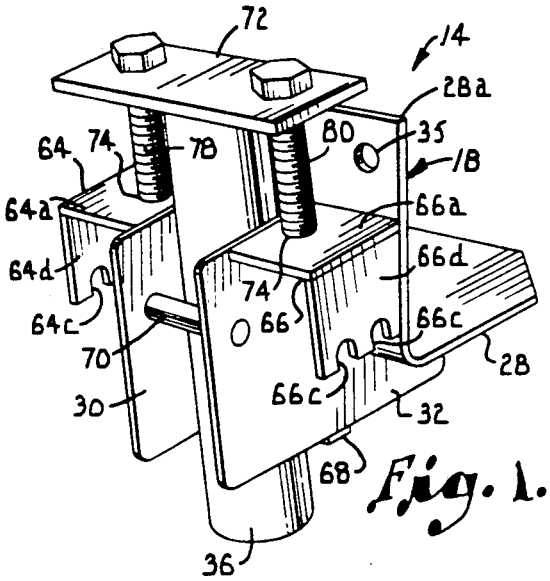
FIG. 1 is a rear perspective view of a bracket assembly made up of L-shaped plate structure, a tubular member which is adapted to be telescoped over the upper end of the shaft of an installed screw anchor, and connector means for joining the tubular member to the L-shaped plate structure.

As best shown in FIGS. 3-8, the present invention contemplates a method and apparatus for supporting a below-grade structural footing or lower part of the foundation 10 forming a part of an existing building. In general, the invention makes use of a number of anchoring assemblies broadly referred to by the numeral 14, each including an elongated earth screw anchor 16 as well as a foundation support assembly 18 serving to place the earth anchor, when embedded in the ground, in supporting, load-bearing relationship to the foundation 10.

In more detail, screw anchor 16 is of conventional design and includes an elongated metallic anchor shaft 20 which may be of square cross-sectional shape and presenting an uppermost butt end 22. The anchor further includes at least one transversely extending load-bearing member such as a metallic helix section secured to shaft 20 adjacent tip 24. Although only a single helix 26 is illustrated in the drawings, it is understood that the screw anchor 16 may have a number of helices along the longitudinal length of shaft 20 in longitudinal spaced relationship.

Figure 2:
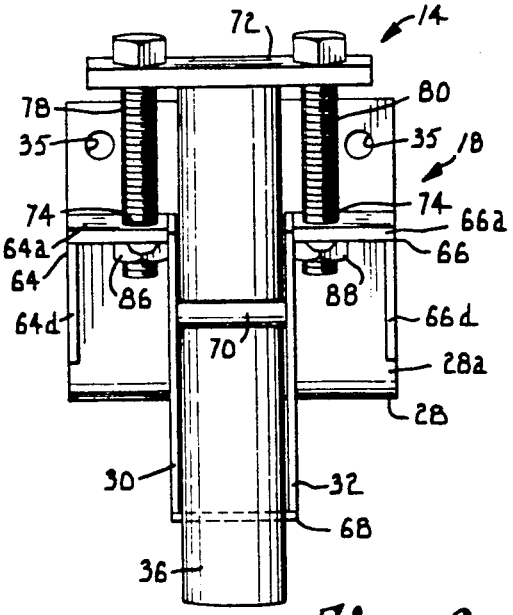
FIG. 2 is a rear elevational view of the bracket assembly illustrated in FIG. 1.

As best shown in FIGS. 1 and 2, foundation support assembly includes an apertured, somewhat L-shaped foundation-engaging plate 28 having a pair of spaced apart, generally parallel apertured walls 30 and 32 welded to the convex face thereof. As best seen in FIGS. 4-8, plate 28 is adapted to mate with and engaged a lower external edge of the foundation 10 and to be permanently attached thereto by means of bolts 34 extending through apertures 35 in the plate 28 and into the foundation material.

Figure 6:
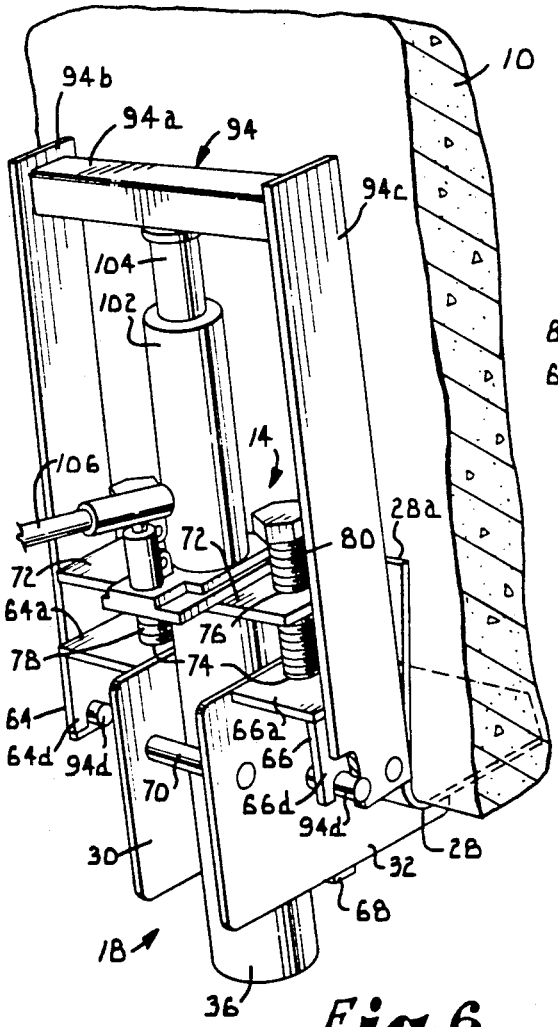
FIG. 6 is a rear perspective view similar to FIG. 5 and further illustrating the bracket assembly and jacking device temporarily positioned in disposition for exerting a lifting force on the L-shaped bracket structure.
Figure 8:
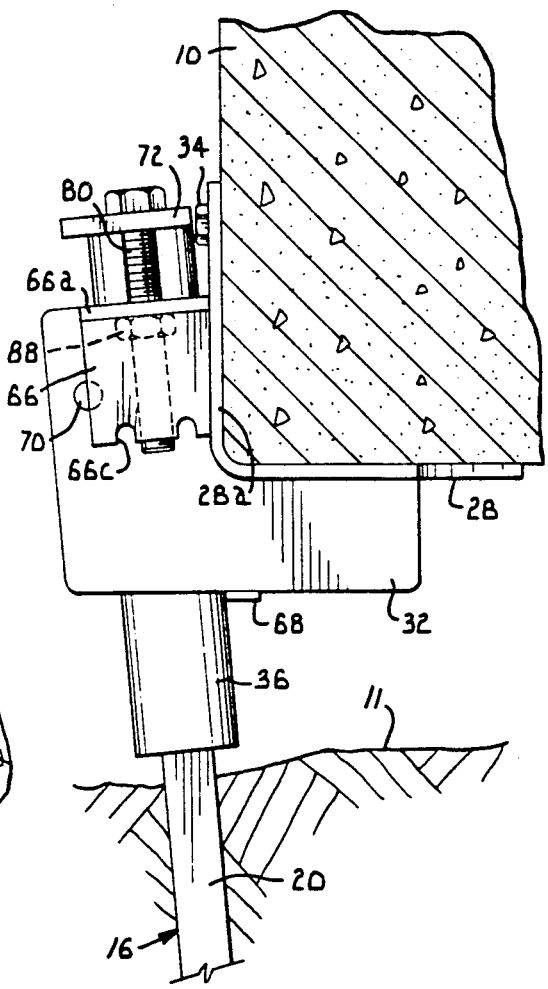
FIG. 8 is a view similar to FIG. 7 but showing the bracket plate connected to the screw anchor after the plate and foundation have been further lifted with respect to a screw anchor driven into the ground.

Two inverted L-shaped wall structures in the form of members 64 and 66 are welded to the upright leg **28*a* of bracket 28 as best shown in FIGS. 1, 2, and 6 with the uppermost legs 64*a* and 66*a* also being welded to respective outermost faces of walls 30 and 32 proximal to the upper edges thereof. An elongated tubular member 36 positioned between inner faces of walls 30 and 32, is adapted to be telescoped over the butt end of screw anchor 20 upon installation of the anchor assembly 14. A cross piece 68 welded to the lower margins of walls 130 and 132 intermediate the ends of such edges serves as a backstop for member 36 while a pin 70 (or bolt if desired) extending through suitable aligned openings in walls 30 and 32 adjacent the upper portions thereof acts as a restraining device immediately forward of L-shaped members 64 and 66. A cross plate 72 welded to the upper end of tubular member 36 and of a width only slightly less than that of the plate 128 overlies the generally horizontal legs 64*a* and 66*a* of L-shaped members 64 and 66**.

The legs **64*a* and 66*a* of members 164 and 166 have openings 74 therein which are normally aligned with similarly sized openings 76 in opposed ends of cross plate 72. Threaded bolts 78 and 80 extend downwardly through respective openings 76 in plate 72 and aligned openings 74 of legs 64*a* and 66*a*. As is most evident from FIGS. 1, 2, 6, and 8, the heads of bolts 78 and 80 overlie cross plate 72, and nuts 86 and 88 are threaded onto bolts 78 and 80 beneath respective legs 64*a* and 66*a*. The tubular member 36, cross plate 72 and bolts 78 and 80 cooperate with L-shaped members 64 and 66 to define connector means for joining the plate 128 to the shaft 20 of anchor 16**.

An inverted U-shaped coupler broadly designated 94 may be temporarily mounted on the anchor assembly 14 and includes a horizontal cross piece **94*a* provided with depending legs 94*b* and 94*c* which are secured to the outermost extremities of the cross piece. Each of the legs 94*b* and 94*c* has a pin 94*d* on the lower end thereof adapted to be received in semicircular recesses 64*c* and 66*c* in the lower edges of the legs 64*d* and 66*d* of L-shaped members 64 and 66** respectively.

When the U-shaped coupler 94 is mounted in position on support assembly 18, the cross plate 72 acts as a temporary support for jacking means such as the hydraulic jack 102 depicted in FIG. 6. The ram 104 of jack 102 engages the underside of cross piece 94 upon extension of the ram 104. Although jack 102 as illustrated in FIG. 6 is depicted for exemplary purposes as being a hand actuated hydraulic unit, it is to be appreciated that such jack may be connected to a source of hydraulic pressure with the supply of hydraulic fluid being remotely controlled.

Figure 4:
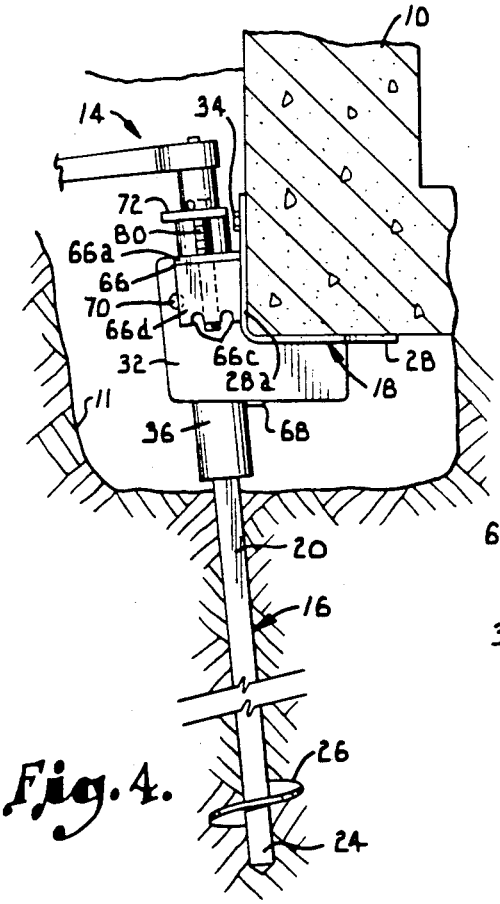
FIG. 4 is a view similar to FIG. 3 on a reduced scale and illustrating the way in which the connector means for joining the tubular member over an anchor shaft to the L-shaped plate structure may be adjusted to assure a firm interconnection between the L-shaped plate structure and the tubular member.
Figure 3:
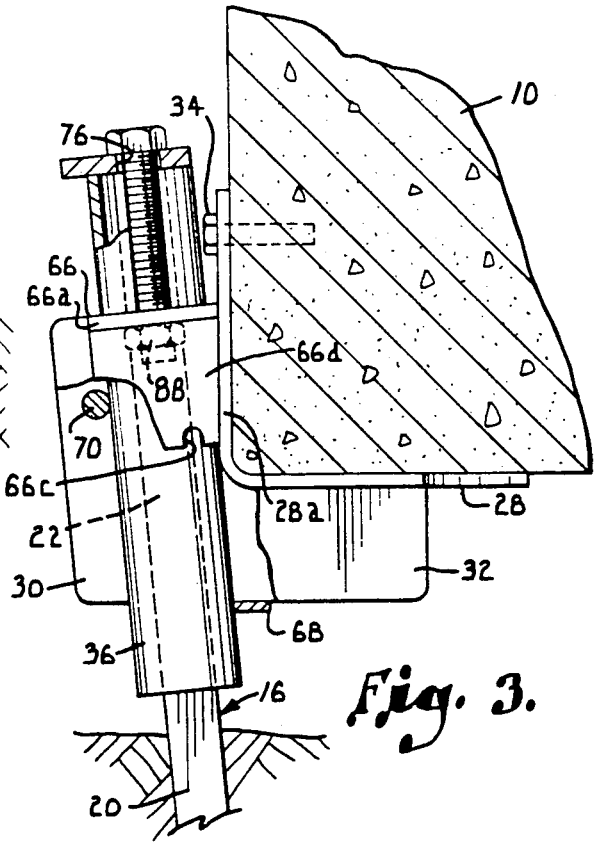
FIG. 3 is an enlarged side elevationsal view of the bracket assembly as depicted in FIGS. 1 and 2, illustrating the way in which the L-shaped plate structure may be positioned to support a footing or foundation, and with the plate structure being mounted on and supported by a screw anchor which has been driven into the ground.

The earth around foundation 10 is excavated as indicated in FIG. 4 by the irregular line 11 to a depth permitting foundation support assembly 18 to be positioned below the foundation 10. Bolts 34 are driven into the foundation or wall structure 10 to firmly affix the plate 28 to the adjacent outer and under surface of the building structure. Screw anchor 16 is then driven into the ground at the point of excavation 11 with the shaft 20 being located between walls 30 and 32 of support assembly 18 which act as vertical guides for the screw anchor. In addition, as best shown in FIG. 4, anchor 16 is driven into the earth below foundation 10 at an angle such that the helix 26 underlies foundation 10. To that end, it is to be seen from FIGS. 4 and 8, that the legs 64*a* and 66*a* of L-shaped members 64 and 66 are at an angle with respect to the adjacent face 28*a* of plate member 28.

After anchor 16 has been driven to a depth such that it has a predetermined holding power (usually obtained by applying a rotational torque to the screw anchor of at least about 1,500 ft-lb and preferably at least about 2,000 ft-lb), the shaft 20 of screw anchor 16 is cut off so that the butt end 22 is substantially at the level of cross plate 72. (If necessary during installation of screw anchor 16, extensions may be added to the upper end of shaft 20 as required to permit driving of such anchor into the ground to a depth such that a predetemined holding power is realized. The holding power in this respect of such anchor should exceed the anticipated dead weight and live load of that part of the building structure supported by the anchor assembly 14 upon final installation thereof.) The tubular member 36 is telescoped over the butt end 22 of shaft 20 and the coupler 96 placed over support assembly 18 with the pins hooked under one of the pair of slots 64*c* and 66*c* of L-shaped member 64 and 66. Jack 102 is then positioned between cross plate 72 and cross piece 94*a* of coupler 94 with the ram 104 in engagement with the underside of cross piece 94*a*. The handle 106 of jack 102 is operated until coupler 94 and thereby support assembly 18 carried thereby has been raised to a desire extent with respect to anchor 120 supporting member 36 and cross piece 72 thereon. If it is desired to exert only a lifting force on foundation 10 through support asembly 18 without actually lifting the foundation so that assurance is obtained that the foundation is fully carried by and supported on assembly 18, it may not be necessary under certain circumstances to actually effect lifting of the foundation 10 relative to screw anchor 16.

In any event, after the required upward force has been exerted on coupler 94 through the medium of jacking device 102, thereby transmitting such lift force to the support assembly 18, the nuts 86 and 88 on bolts 78 and 80 are rotated until they come into firm engagement with the undersides of respective walls 64*a* and 66*a* thereby firmly affixing the cross member 72 and tubular member 36 supported by anchor shaft 20 to the bracket assembly made up of walls 30 and 32, L-shaped members 64 and 66, and plate 28. Ram 104 of jacking device 102 may thereafter be lowered so that the jack can be removed from its position between cross member 72 and cross piece 94*a*.

One feature of anchor assembly 14 is the fact that if it is desired at a later time to again lift the foundation 10 relative to the anchor 16, this can be readily accomplished by re-excavation of the area around support assembly 18 and to repeat the procedure described above followed by retightening of the bolts 78 and 80 and associated nuts 86 and 88.

DESCRIPTION OF ANOTHER EMBODIMENT OF THE INVENTION

Figure 9:
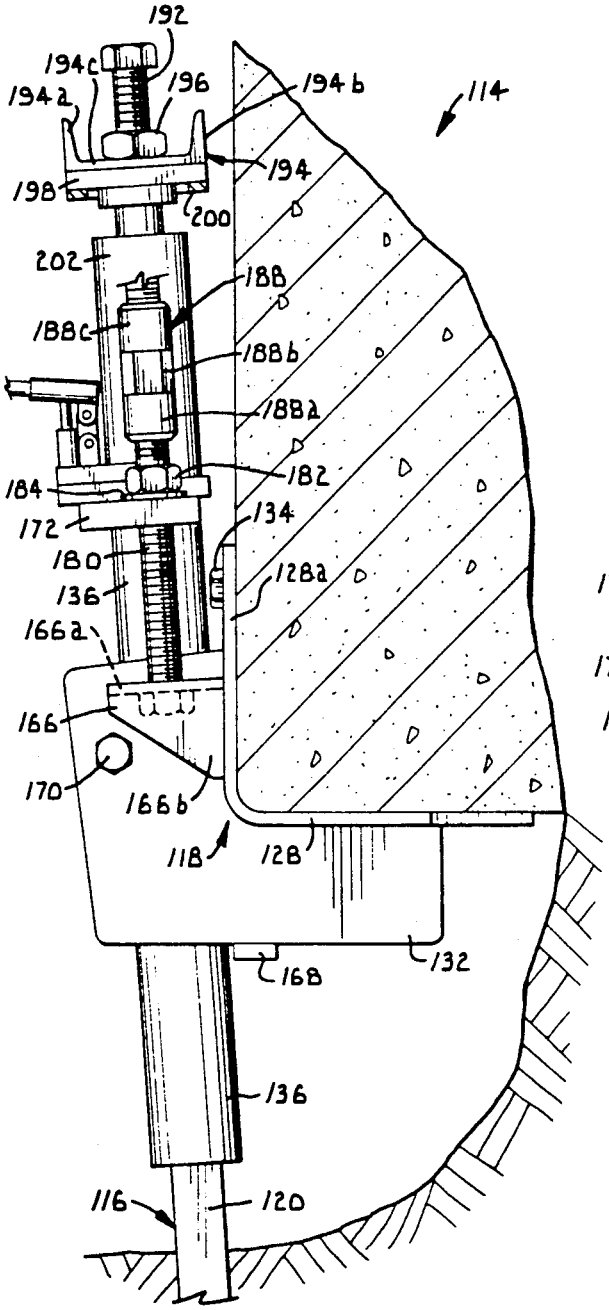
FIG. 9 is an enlarged side elevational view of a bracket assembly constructed in accordance with a further embodiment of the invention, illustrating the way in which the L-shaped plate structure may be positioned to support a footing or foundation, and with the plate structure being mounted on and supported by a screw anchor which has been driven into the ground.
Figure 10:
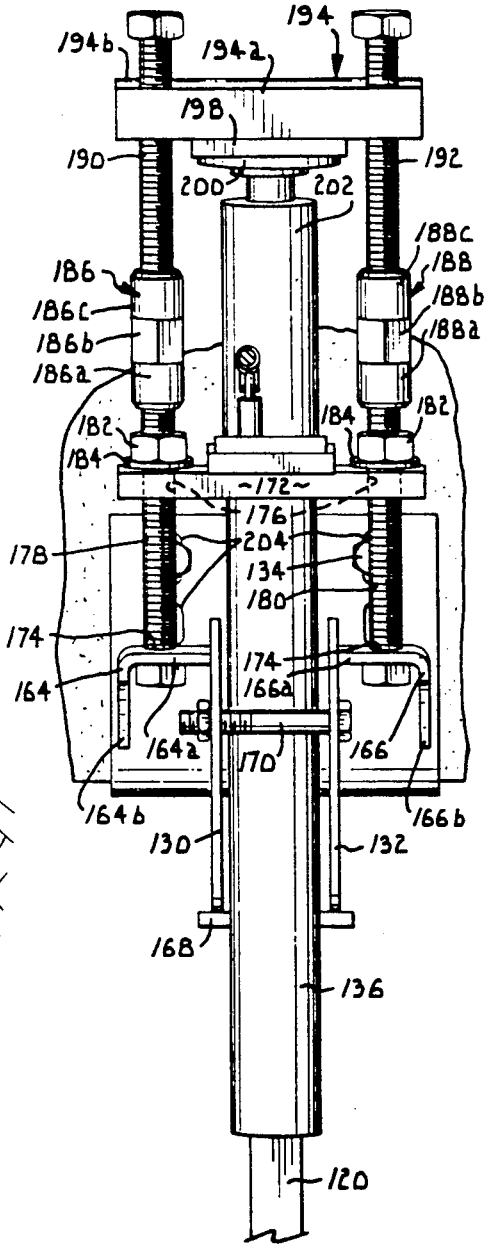
FIG. 10 is a rear elevational view of the bracket assembly illustrated in FIG. 9.

A futher embodiment of the invention, and which is preferred in certain instances is illustrated in FIGS. 9 and 10.

As shown in FIG. 9, each anchoring assembly broadly designated 114 includes an earth anchor 116 identical to or similar to anchor 16, as well as a foundation support or bracket assembly 118 which differs from the bracket 18 but performs an essentially equivalent foundation support function.

As shown in FIGS. 9 and 10, the bracket assembly 118 includes an L-shaped foundation-engaging plate 128 having a pair of spaced apart, generally parallel apertured walls 130 and 132 secured to the convex face thereof. Plate 128 is also adapted to engage the lower external edge of a foundation 10 and to be permanently attached thereto by suitable bolts in the same fashion as previously described with respect to bracket assembly 18.

Two normally horizontally spaced, inverted L-shaped members 164 and 166 are welded to the upright leg 128*a* of plate 128 as best known in FIG. 9 with the uppermost, horizontal leg segments 164*a* and 166*a* thereof also being welded to the outer faces of upright walls 130 and 132. An elongated tubular member 136 is positioned between opposed inner faces of walls 130 and 132 and is adapted to be telescoped over the upper end of screw anchor shaft 120 upon installation of the bracket assembly 118. A cross piece 168 welded to the lower margins of walls 130 and 132 intermediate the ends of such edges serves as a backstop for member 136 while a bolt 170 extending through suitable aligned openings in walls 130 and 132 adjacent the upper portions thereof, acts as a restraining device for the member 136 within the confines of L-shaped members 164 and 166. A cross plate 172 welded to the upper end of tubular member 136 and of a length only slightly less than the width of the plate 128 overlies the generally horizontal legs 164*a* and 166*a* of L-shaped members 164 and 166.

The legs 164*a* and 166*a* of members 164 and 166 have openings 174 therein which are normally aligned with similarly sized openings 176 in opposed ends of cross plate 172. If desired, during punching of the openings 174, the surrounding surface of legs 164*a* and 166*a* respectively may be formed downwardly to present substantially semispherical surfaces surrounding corresponding openings. Inverted threaded bolts 178 and 180 extend upwardly through respective openings 174 and aligned openings 176 of cross plate 172. As is most evident from FIG. 9, the heads of such bolts 178 and 180 underlie and engage the bottom surfaces of the legs 164*a* and 166*a* of members 164 and 166. The semispherical surfaces of legs 164*a* and 166*a* around corresponding openings 174 allows some movement of bolts 178*a* for alignment purposes with respect to the member 136 and plate 172 thereon.

Nuts 182 are threaded over each of the bolts 178 and 180 above cross plate 172 with washers 184 being provided between each of the nuts 182 and the cross plate 172.

Two special jacking nuts 186 and 188 have right-hand threaded passages in the normally lowermost ends 186*a* and 188*a* thereof for threaded receipt of the upper ends of respective bolts 178 and 180. The central sections 186*b* and 188*b* are formed to present wrench-receiving flats to facilitate rotation of such jacking nuts. The upper extremities 186*c* and 188*c* also have axial right-handed internally threaded passages for receipt of corresponding threaded bolts 190 and 192 respectively which project upwardly and are axially aligned with bolts 178 and 180.

A cross channel broadly designated 194 is positioned directly above cross plate 172 and has two upstanding legs 194*a* and 194*b* integral with a lower bottom wall 194c. In order to accommodate the threaded bolts 190 and 192, the bottom wall 194c of channel 194 has a pair of openings 194d therethrough and spaced such that they will axially align with the openings 176 through cross plate 172. Thus, the headed bolts 190 and 192 are adapted to extend through corresponding openings 194d and to thread into special jacking nuts 186 and 188 as shown in FIG. 9. Additional nuts 196 provided within the channel 194 are also threaded onto bolts 190 and 192 above the bottom wall 194d of the channel.

A reinforcement member 198 welded to the underside of wall 194d between bolts 190 and 192 reinforces wall 194d and also serves as a mount for an annulus 200. As best shown in FIG. 9, a jack 202 may be positioned between cross plate 172 and channel 194 with the ram 204 of such jack received within the annulus 200. Although the jack 202 as illustrated in FIG. 9 is depicted for exemplary purposes as being a hand actuated hydraulic unit, it is to be appreciated that such jack may be connected to a source of hydraulic pressure with the supply of hydraulic fluid being remotely controlled.

In the use of assemblies 114, the building structure to be stabilized is first inspected to determine its calculated weight or total dead load. Next, the installer makes a calculation of the anticipated live loads which are likely to be experienced by that building structure after stabilization of the foundation, depending upon the geographical locale of the building and the conditions of snow load, wind loads, persons habiting the structure, equipment or stock to be stored therein, and any other variable loads that are normally taken into account during determination of the assumed total live load. The perimeter of the foundation of the building structure to be stabilized is then measured so that the calculated combined dead weight and live load "w" of the building structure per lineal foot of foundation may be determined (lb/ft).

The installer next determines the total number of bracket assemblies 118, and establishes where such bracket assemblies should be located depending upon the dead weight and any live load "w" at specific locations around the perimeter of the building. For example, if it is found that a particular part of the building is calculated to have a greater combined dead weight and live load on the foundation than is the case with other parts of such building structure, the installer may determine that a greater number of bracket assemblies 118 in closer spaced relationship may be required for heavier perimeter portions of the building than is the case with other sections of such building around the perimeter thereof. In all instances though, it has been determined that the anchoring assemblies 114 should be spaced at intervals of no less than about 4 lineal feet along the foundation. If the assemblies 114 are spaced closer than about 4 feet apart, the screw anchors 116 of each assembly 114 can disturb the soil in surrounding relationship thereto to an extent radially from a respective anchor that the holding power of each anchor may thereby be compromised.

In determining the total number of anchor assemblies 114 "N" (unitless) required for stabilizing a building structure which may or has experienced settlement or movement, variables that must be taken into account include the combined dead weight and live load "w" of that structure, the lineal feet "x" along the foundation (ft), and the capacity "S" of each bracket assembly 118 (lb). For most applications, a typical bracket assembly 118 in this respect should have a rated capacity of at least about 15,000 lbs.

The total number of brackets required for a specific installation therefore may be determined in accordance with the formula $$N = \frac{w(x)}{S} \qquad \text{[II]}$$

The lineal spacing of anchor assemblies 114 may be calculated in accordance with the formula $$S_p = \text{spacing} = x/N \qquad \text{[III]}$$

As previously indicated, the earth around the foundation is excavated at each position where it has been determined that an anchoring assembly 114 should be located to properly stabilize the building foundation. If it is desired that a respective bracket assembly 118 be used as a guide for installation of a screw anchor 116 (by locating the shaft 120 between upright walls 130 and 132 of the corresponding bracket assembly 118), the bracket assembly 118 is bolted to the foundation or footing in a manner similar to that illustrated in FIGS. 4 and 5. For that purpose, plate 128 has a series of elongated openings 204 therein for receipt of anchor bolts.

Figure 5:
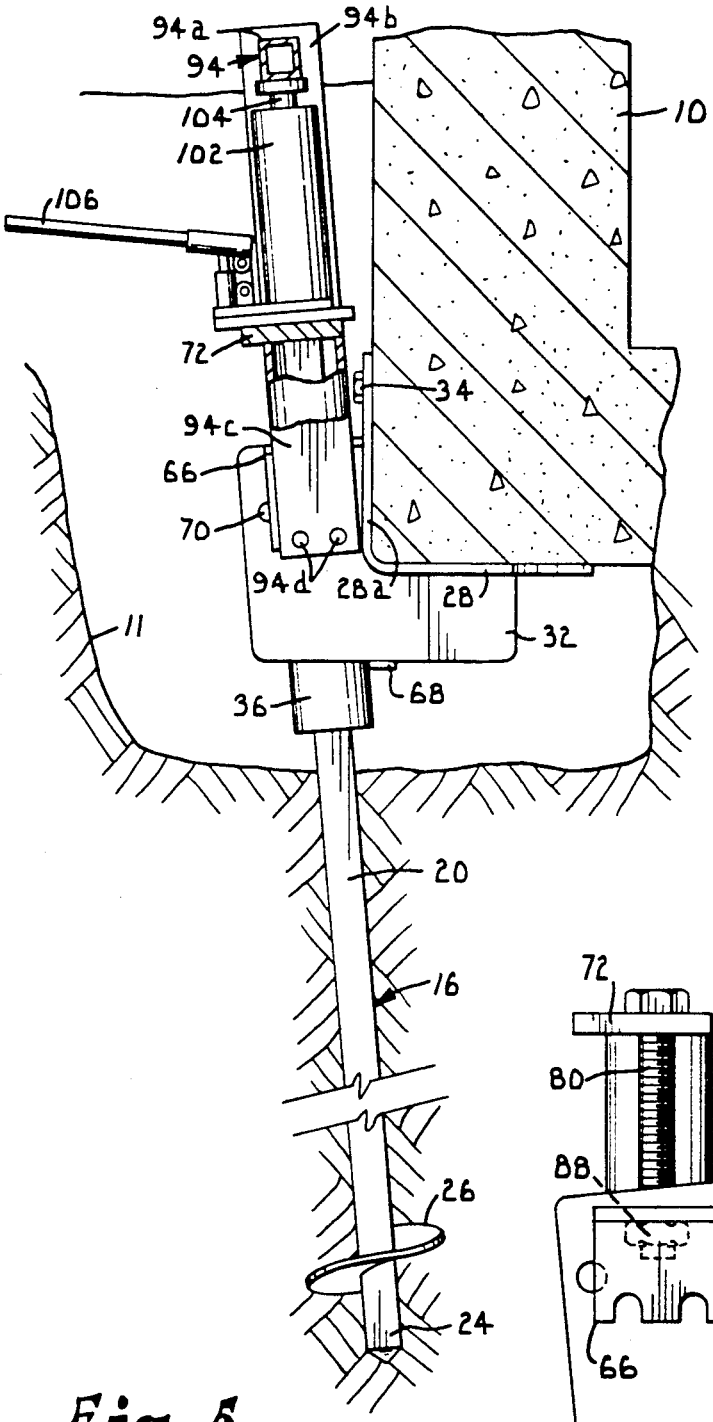
FIG. 5 is a view similar to FIG. 4 on a somewhat larger scale and illustrating the way in which a temporarily positioned jacking device may be used to lift the L-shaped plate structure and foundation thereon relative to a screw anchor which has been driven into the ground adjacent the bracket assembly.
Figure 7:
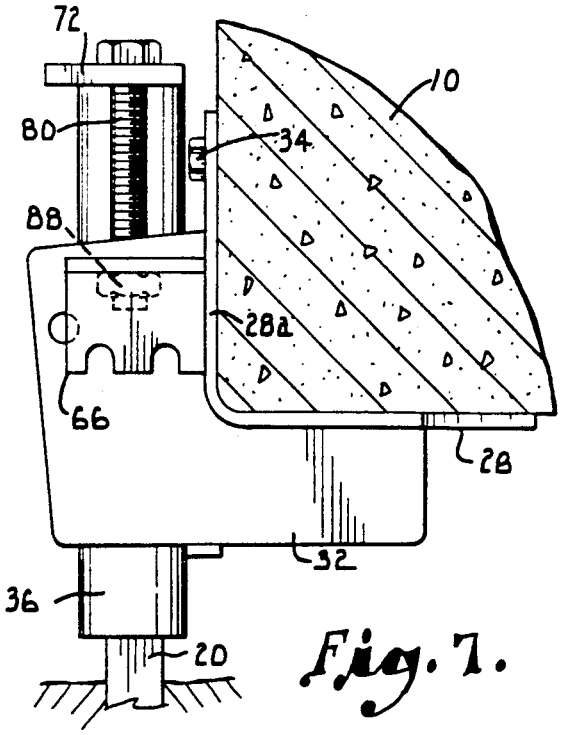
FIG. 7 is a fragmentary side elevational view showing the bracket assembly in supporting relationship to a foundation wherein the L-shaped bracket structure is carried by the anchor shaft but before the bracket structure and foundation have been lifted relative to the screw anchor.

After placement of the screw anchor in a respective excavated opening at an angle with respect to the vertical and with the shaft 120 properly positioned between walls 130 and 132, rotational torque is imparted to such screw anchor through torque applying means such as the hydraulic drive head as shown in FIG. 5. Sufficient rotational torque is imparted to each screw anchor as a force independent of a corresponding bracket assembly 118 and the foundation 10 until a value of at least about T=500 lb-ft is achieved in accordance with the formula $$T = \frac{w(x)(S.F.)}{n(N)} \qquad \text{[I]}$$

where, "w"=the calculated combined dead weight and live load of the building structure per lineal foot of foundation (lb/ft), "x"=lineal feet along the foundation (ft), "S.F." (safety factor)=at least 1.0, "n"=8 to 20 (empirical multiplier for torque versus holding power of screw anchor, 1/ft.), and "N"=number of screw anchors and associated supports to be used in stabilizing the building structure determined by formula [II]. In most instances, it is desirable that screw anchors be employed having transversely square shafts of at least about 1½ inches across the flats. Similarly, the helices should have a minimum diameter of at least about 6 inches. Shaft dimensions of up to about 4 inches may be used with maximum helix dimensions of about 16 inches. Furthermore, multi-helix screw anchors may be used with the spacing between adjacent helices being anywhere from about 18 to as much as 42 inches. The rotational torque applied to the screw anchor should be at least about 1,500 ft-lb, and preferably at least about 2,000 ft-lb.

The safety factor (S.F.) in formula [I] expressed as a minimum of 1.0, preferably should be at least about 2.0. This means that if a weight "w" is to be stabilized using anchoring assembly 114, the assembly should be capable of supporting at least about 2w.

Upon reaching a predetermined rotational torque, such torque is released from the anchor that has been driven into the ground adjacent the foundation, and the anchor is then permitted to return to its unstressed state. This permits attachment of the screw anchor to the associated bracket assembly 118 without any rotational forces being translated from the screw anchor to the bracket that would tend to turn such bracket in a direction away from the foundation.

The tubular member 136 is then telescoped over the uppermost extremity of shaft 120 of the screw anchor 116 with the cross plate 172 coming to rest on the top of the shaft 120 with the member 136 located between walls 130 and 132 of bracket assembly 118 and adjacent the backstop 168. Bolt 170 is then threaded through the aligned openings therefor and walls 130 and 132 and the nut attached to trap the member 136 between bolt 170 and backstop 168.

The bolts 178 and 180 are inserted upwardly through legs 164*a* and 166*a* of L-shaped members 164 and 166 and through the openings 176 in cross plate 172 whereupon nuts 182 are threaded down onto respective uppermost ends of bolts 178 and 180. Special jacking nuts 186 are then threaded onto the uppermost ends of the bolts 178 and 180. Assuming that the bolts 190 and 192 have been passed through openings 194*d* in the bottom of 194*c* of channel 194 after placement of nuts 196 thereon, the lowermost ends bolts 19 and 192 are then threaded into the upper ends 186*c* and 188*c* of special jacking nuts 186 and 188. The spacing between cross plate 172 and channel 194 should be such that jack 202 may be placed between the cross plate 172 and plate 198 with the ram within annulus 200.

The installer then applies an upward force on channel 194 by operating the handle of the jack (or supplying hydraulic pressure from the remote source) to transfer this upward force to the channel 194. By virtue of the fact that the nuts 196 on bolts 190 and 192 engage the upper surface of the bottom 194*c* of the channel, the jacking force is transmitted directly to the L-shaped members 164 and 166 by the combination of bolts 190 and 192, jacking nuts 186 and 188 and associated bolts 178 and 180. This upward force is likewise transmitted to the bracket plate 128 which is applied directly to the foundation resting on bracket assembly 118. The force applied by jack 202 between cross plate 172 and channel 194 causes such members to tend to move relatively.

By virtue of the fact that the combined dead weight of the building and any live load at an anchor installation position is transferred to the screw anchor after rotational torque thereon has been relaxed, the installer of anchor assembly 114 is assured that the requisite support for the foundation is obtained in all instances. In past practices, where a piling is driven into the ground using hydraulic cylinders coupled to the piling, the fulcrum for the hydraulic cylinders is the foundation itself. Thus, the piling can only be driven to a depth allowed by the weight of the building. Accordingly, when the hydraulic cylinders are disconnected from the piling, there is no built-in safety factor preventing further settling of the pilings over time in that that maximum holding power was obtained at the time of installation when the weight of the building determine the holding power of the pilings. For example, when the moisture content of the soil surrounding the pile changes, the frictional resistance provided by the soil also changes. An increase or decrease in the moisture content of the soil surrounding the piling decreases the skin resistance of the piling. Accordingly, the building is free to again settle or move.

After the bracket assembly 118 has been lifted to a required extent or the force applied thereto brought to a requisite level, the nuts 182 are rotated in a direction to bring them into height engagement with the washers 184 resting on cross plate 172. This firmly affixes the screw anchor 116 to the bracket assembly 118.

Thereupon, the jack 202 may be withdrawn from its position between channel 194 and cross plate 172. Following that, the assembly made up of channel 194, bolts 190 and 192 and jacking nuts 186 and 188 may be removed from the bolts 178 and 180.

Another feature of anchoring assembly 114 is the fact that at some later time, if it is desired to again apply a force to the bracket assembly 118 to further stabilize the foundation, this can be accomplished by simply excavating the area where a particular bracket and screw anchor are located, mounting the U-shaped unit made up of channel 194, bolts 190 and 192 and jacking nuts 186 and 188 on bolts 178 and 180, reapplying an upward force on channel 194 with a jack inserted between such channel and cross plate 172, and thereafter removing the channel-bolt and jacking nut U assembly from the bracket 118. This procedure can be repeated as many times as necessary and can be carried out differentially along the length of the foundation.

In certain instances, if the weight on assembly 118 is such that a jacking device 202 is not required to lift the weight, a wrench may be applied to the nuts 182 to rotate the nuts in a direction to pull the L-shaped members 164 and 166 and thereby the plate 128 attached thereto toward cross member 172 and raise the bracket as well as the foundation 10. In most instances, the nuts 182 should be rotated in sequential order with one nut being rotated a small amount followed by rotation of the other nut 182. In these instances, the overlying coupler structure used with jack 202 is not essential.

Although the invention has been described with reference to preferred embodiments shown in the figures, it is noted that substitutions may be made and equivalents employed herein without departing from the scope of the invention as defined in the claims.

I claim:

1. An apparatus for stabilizing the foundation of an existing building structure which may or has experienced settlement or movement, said apparatus comprising:

a support for the foundation adapted to be located at a position along the length thereof; and a screw anchor having an anchor shaft and at least one helix thereon, said screw anchor being adapted to be embedded in the earth in generally upright disposition adjacent the foundation support, said support including plate means adapted to be disposed in supporting relationship to the foundation, connector means for joining the plate means to the anchor shaft, said connector means having a base member for temporarily supporting jacking means thereon, and a coupler releasably secured to the plate means and adapted to be engaged by jacking means temporarily supported on the base member, the coupler including horizontally spaced generally upright elements releasably connected to said plate means in disposition outboard of the axis of the anchor shaft so that the jacking means may be positioned between the base member and the coupler in substantially axial alignment with the anchor shaft, and a cross member between the upright elements in sufficiently spaced relationship from the base member to temporarily accommodate the jacking means between the base member and the cross member, whereby upon positioning of the support in supporting relationship to the foundation and insertion of the anchor in the ground, the support may be connected to the anchor shaft, the jacking means positioned between the base member and the coupler so that added force may be applied to the support and thereby the foundation while the support and foundation are carried by the screw anchor, the support then affixed to the screw anchor, and the jacking means thereafter removed from its position between the base member and the coupler, said connector means including spaced wall structures secured to the plate means in disposition for receipt of the anchor shaft therebetween, and fastening means for connecting the base member to the wall structure after the jacking means has been operated to apply said added force to the foundation support while the jacking means is positioned between the base member and the coupler, said fastening means including adjustable bolt means extending between the base member and the wall structures; said adjustable bolts means including a pair of bolts extending through the base member and corresponding wall structures, there being means on said bolts engageable with said cross member and respective wall structures for preventing relative movement of the wall structures and thereby the support in a direction away from the cross member supported by the anchor shaft.

2. An apparatus for stabilizing the foundation of an existing building structure which may or has experienced settlement or movement, said apparatus comprising:

a support for the foundation adapted to be located at a position along the length thereof; and a screw anchor having an anchor shaft and at least one helix thereon, said screw anchor being adapted to be embedded in the earth in generally upright disposition adjacent the foundation support, said support including plate means adapted to be disposed in supporting relationship to the foundation, connector means for joining the plate means to the anchor shaft, said connector means having a base member for temporarily supporting jacking means thereon, and a coupler releasably secured to the plate means and adapted to be engaged by jacking means temporarily supported on the base member, said coupler including an elongated, normally horizontal cross element, and a pair of elongated, longitudinally adjustable extensions interconnecting the plate means and the cross element on opposite sides of an upright, imaginary projection of the axis of the anchor shaft, whereby upon positioning of the support in supporting relationship to the foundation and insertion of the anchor in the ground, the support may be connected to the anchor shaft, the jacking means positioned between the base member and the coupler so that added force may be applied to the support and thereby the foundation while the support and foundation are carried by the screw anchor, the support then affixed to the screw anchor, and the jacking means thereafter removed from its position between the base member and the coupler said connector means including a pair of threaded members engaging the plate means and extending through the base member on opposite sides of the anchor shaft, said adjustable extensions being threadably joined to the threaded members for ready connection and removal of the extensions from the threaded members.

3. In the apparatus as set forth in claim 2, wherein said adjustable extensions comprise bolt means extending through the cross element and releasably connected to the threaded members.

4. An apparatus for stabilizing the foundation of an existing building structure which may or has experienced settlement or movement, said apparatus comprising:

a support for the foundation adapted to be located at a position along the length thereof; and a screw anchor having an anchor shaft and at least one helix thereon, said screw anchor being adapted to be embedded in the earth in generally upright disposition adjacent the foundation support, said support including plate means adapted to be disposed in supporting relationship to the foundation, connector means for joining the plate means to the anchor shaft, said connector means having a base member for temporarily supporting jacking means thereon, and a coupler releasably secured to the plate means and adapted to be engaged by jacking means temporarily supported on the base member, the coupler including horizontally spaced generally upright elements releasably connected to said plate means in disposition outboard of the axis of the anchor shaft so that the jacking means may be positioned between the base member and the coupler in substantially axial alignment with the anchor shaft, and a cross member between the upright elements in sufficiently spaced relationship from the base member to temporarily accommodate the jacking means between the base member and the cross member, whereby upon positioning of the support in supporting relationship to the foundation and insertion of the anchor in the ground, the support may be connected to the anchor shaft, the jacking means positioned between the base member and the coupler so that added force may be applied to the support and thereby the foundation while the support and foundation are carried by the screw anchor, the support then affixed to the screw anchor, and the jacking means thereafter removed from its position between the base member and the coupler, said connector means including spaced wall structures secured to the plate means in disposition for receipt of the anchor shaft therebetween, and fastening means for connecting the base member to the wall structure after the jacking means has been operated to apply said added force to the foundation support while the jacking means is positioned between the base member and the coupler, said fastening means including adjustable bolt means extending between the base member and the wall structures and including a pair of bolts extending through the base member and corresponding wall structures, there being means on said bolts engageable with said cross member and respective wall structures for preventing relative movement of the wall structures and thereby the support in a direction away from the cross member supported by the anchor shaft, said means on the bolts engageable with said cross member including a nut threaded on each bolt and engageable with the base member on the side thereof away from respective wall structures whereby after a force has been applied to the coupler by the jacking means temporarily positioned between the base member and the coupler, the nuts may be tightened against the base member to preclude relative movement of the wall structures and thereby the foundation carried by the plate means in a direction away from the base member and the anchor shaft.

5. In the apparatus as set forth in claim 4, wherein said connector means includes a tubular member telescoped over the upper end of the anchor shaft, said cross member being secured to the upper end of the tubular member.

6. In the apparatus as set forth in claim 5, wherein is provided restraining means on said wall structures engageable with said tubular member for preventing rotation thereof in a direction such that the upper end of the shaft would move away from the support.

7. In the apparatus as set forth in claim 6, wherein said restraining means includes a first component on one side of the tubular member below the plate means and a second component on the opposite side of the tubular member above said first component.

* * * * *